US011723438B2

(12) United States Patent
Millward et al.

(10) Patent No.: US 11,723,438 B2
(45) Date of Patent: Aug. 15, 2023

(54) ADJUSTMENT BUCKLE ASSEMBLY

(71) Applicant: Illinois Tool Works Inc., Glenview, IL (US)

(72) Inventors: Eric W. Millward, Evanston, IL (US); Scott D. Kolasa, Mount Prospect, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/411,465

(22) Filed: Aug. 25, 2021

(65) Prior Publication Data

US 2022/0061467 A1 Mar. 3, 2022

Related U.S. Application Data

(60) Provisional application No. 63/069,915, filed on Aug. 25, 2020.

(51) Int. Cl.
*A44B 11/04* (2006.01)

(52) U.S. Cl.
CPC ..... *A44B 11/04* (2013.01)

(58) Field of Classification Search
CPC ..... A44B 11/04; A45F 3/047
See application file for complete search history.

(56) References Cited

U.S. PATENT DOCUMENTS

| | | | | |
|---|---|---|---|---|
| 5,113,553 | A * | 5/1992 | Hutchinson | A44B 17/0029 24/470 |
| 6,497,003 | B2 * | 12/2002 | Calabrese | B60N 3/046 296/97.23 |
| 7,546,661 | B2 * | 6/2009 | Connor, Jr. | B60N 3/046 24/297 |
| 7,945,992 | B2 * | 5/2011 | Parisi | B60N 3/046 16/8 |
| 8,375,514 | B2 * | 2/2013 | Dendo | B60N 3/046 16/8 |
| 8,402,605 | B2 * | 3/2013 | Courtin | B60N 3/046 16/8 |
| 8,882,171 | B2 * | 11/2014 | Goto | B60N 3/046 296/97.23 |
| 9,669,745 | B2 * | 6/2017 | Machida | F16B 2/12 |
| 9,750,328 | B2 * | 9/2017 | Coutant | A45C 13/02 |
| 2021/0253005 | A1 * | 8/2021 | Satvilkar | F16B 21/073 |

* cited by examiner

*Primary Examiner* — Robert Sandy
*Assistant Examiner* — Louis A Mercado
(74) *Attorney, Agent, or Firm* — Quarles & Brady LLP

(57) ABSTRACT

An adjustment buckle assembly includes a first component having a shaft extending from a flange and a second component having a receptacle formed through a base. The shaft is configured to be at least partially inserted into the receptacle and tapers inwardly relative to a central axis extending centrally through the first component. The shaft carries a plurality of teeth that are configured to engage with a plurality of ribs carried on the second component.

15 Claims, 15 Drawing Sheets

ADJUSTMENT BUCKLE ASSEMBLY

RELATED APPLICATIONS

This application claims the benefit of priority to U.S. Provisional Application No. 63/069,915, filed on Aug. 25, 2020, which is incorporated by reference herein in its entirety.

BACKGROUND

Field of the Disclosure

The present invention relates to an adjustment buckle. More specifically, a two-piece adjustment buckle assembly with a ratchet is shown and described herein.

Description of the Background of the Disclosure

In recent years, adjustment buckles have been developed to fasten straps to items or to other straps. For example, luggage such as backpacks, duffel bags, suitcases, etc., often includes various straps made of relatively stiff piping, e.g., plastic sting trimmer cord, wrapped in webbing and connected to adjust the luggage relative to a user, such as, e.g., tightening or loosening a strap.

Certain known adjustment buckles are unitary devices that are fastened to the luggage by a piece of webbing that is attached via stitching. As depicted in FIG. 1, a conventional adjustment buckle 100 receives webbing 102 therethrough for adjustment, while a separate webbing strip 104 includes a Z-shaped pattern of stitching 106 that couples the strip 104 to a backpack strap 108. In particular, the stitching 106 couples the adjustment buckle 100 to a front surface 110 of the backpack strap 108. Further, the strip 104 is coupled to the adjustment buckle 100 by a first loop 112 around a portion of the adjustment buckle 100, and the first loop 112 does not allow adjustment between the adjustment buckle 100 and the strip 104. However, the webbing 102 is coupled to the adjustment buckle 100 by a second loop 114 to allow for adjustment therebetween. In order to adjust the backpack strap 108 to be tightened or loosened, a user can tilt the adjustment buckle 100 so that the second loop 114 becomes loosened in relation to the adjustment buckle 100 while a user grasps an end of the webbing 102 to either draw or release webbing 102 through the adjustment buckle 100.

However, improved adjustment buckles are needed and, in particular, improvements to the rigidity of the adjustment buckle and a method of mounting an adjustment buckle are needed.

SUMMARY

In one aspect, an adjustment buckle assembly includes a first component having a shaft extending from a flange and a second component having a receptacle formed through a base. The shaft is configured to be at least partially inserted into the receptacle and tapers inwardly relative to a central axis extending centrally through the first component. The shaft carries a plurality of teeth that are configured to engage with a plurality of ribs carried on the second component.

In another aspect, an adjustment buckle assembly includes a main body including a hollow shaft extending from a flange, the hollow shaft including opposing walls each carrying a set of teeth thereon. A backplate includes opposing surfaces each carrying a rib that is disposed within a receptacle. The opposing walls of the shaft are configured to be aligned with the opposing surfaces of the backplate, and the opposing walls are disposed at an angle relative to a vertical axis.

In still another aspect, a method of providing an adjustment buckle assembly includes providing a first component having a flange, a hollow shaft, and a bar extending between opposing sides of the shaft and providing a second component having a receptacle and a rim extending along a periphery of the receptacle and protruding outwardly from a top surface. The shaft is configured to be received within the receptacle and includes a plurality of posts that are configured to be aligned with and received by a plurality of channels of the second component.

Figure 1:
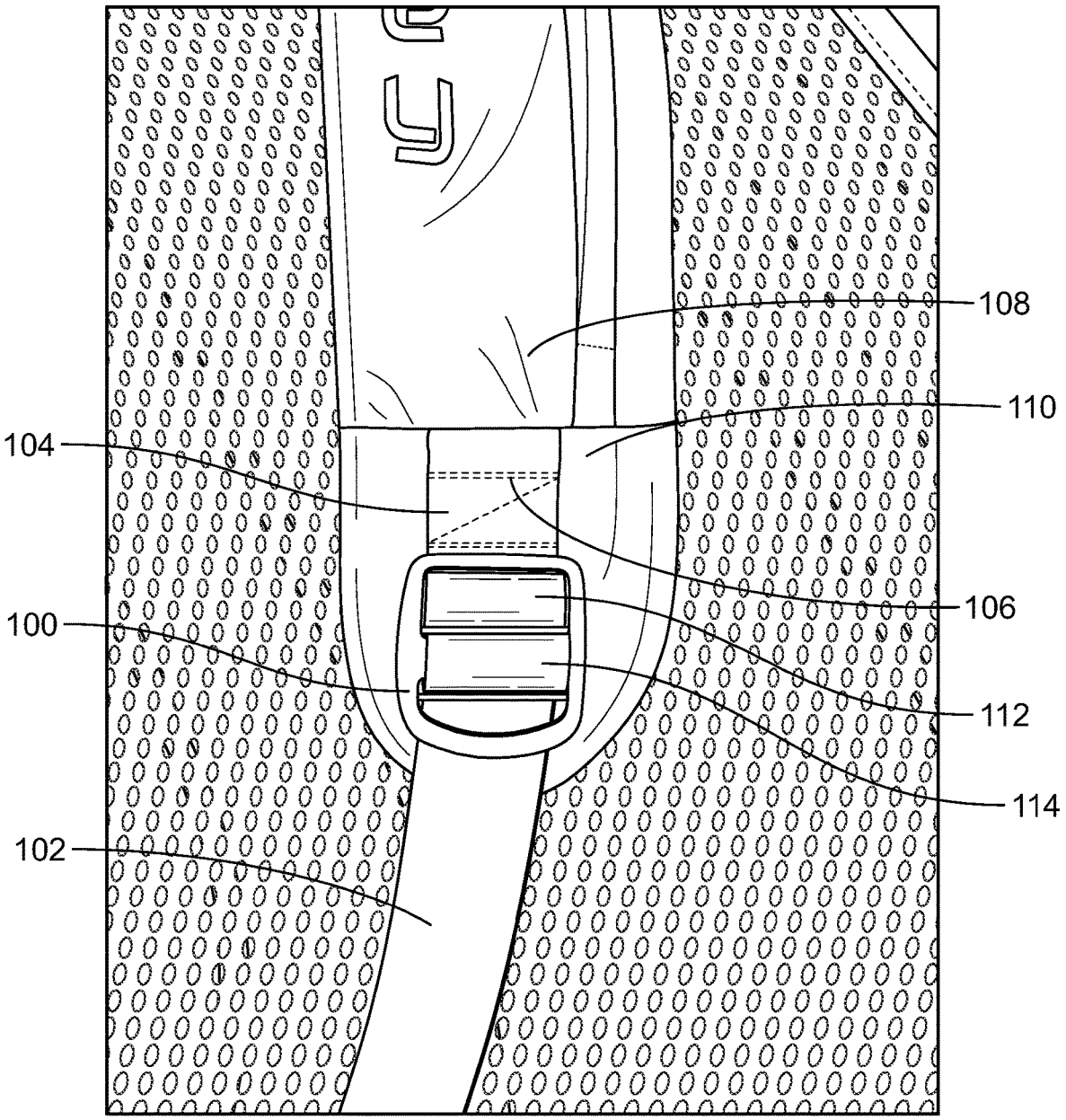
FIG. 1 is a top view of a conventional adjustment buckle coupled to a backpack strap.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

As will be described in detail below, this disclosure generally relates to an adjustment buckle assembly that may be mounted to luggage, or similar items, through a hole formed therein and by clamping portions of the luggage between a first component and a second component. In addition, the adjustment buckle assembly of the present disclosure includes a ratchet for coupling the first component to the second component. The ratchet may be configured to tighten a fit in proportion to an increasing clamping force applied to the portions of the luggage disposed between the first component and the second component.

Further, the first component may include a flange extending outwardly from an upper end of a hollow shaft. The shaft may include opposing sides on which a set of teeth of the ratchet is carried, and a passage may be formed through the shaft and the flange. The opposing sides of the shaft, including the sets of teeth carried thereon, may be tapered relative to a central axis extending through the first component. A bar may extend transversely across the passage and webbing may be looped around multiple sides of the bar during use for adjustment of the backpack strap by a user. In addition, the second component may include a base and a receptacle that is at least partially defined by a rim. The receptacle can be disposed substantially centrally through the base and configured to receive a portion of the shaft of the first component. Further, opposing interior surfaces of the rim may carry a rib of the ratcheting feature that is configured to engage with the sets of teeth carried by corresponding sides of the shaft when the first and second component are assembled.

Figure 2:
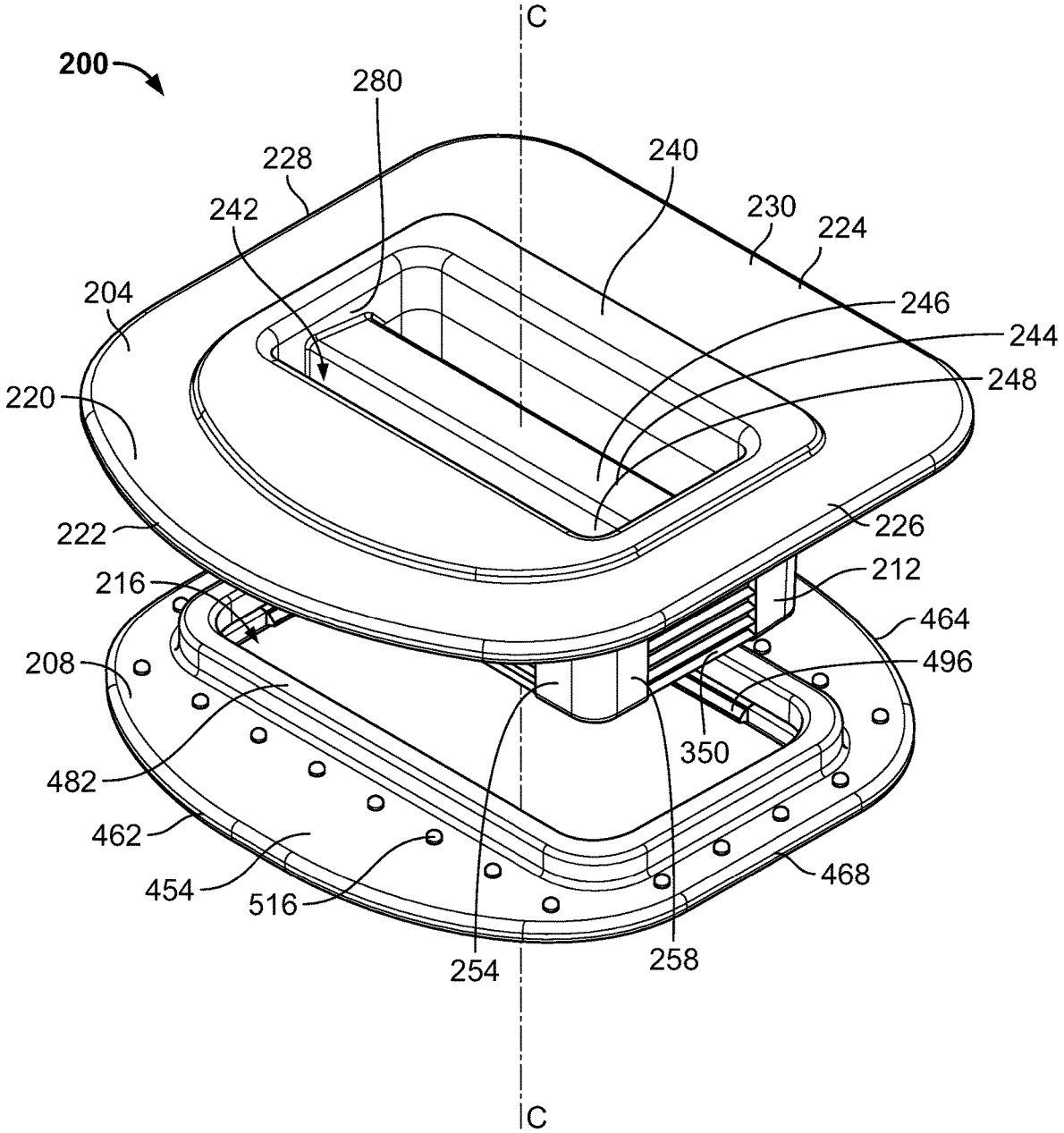
FIG. 2 is an isometric view of a top, front and side of an adjustment buckle assembly according to an embodiment of the present disclosure, the adjustment buckle assembly being depicted in an unassembled state.

FIG. 2 is an exploded isometric view of one embodiment of an adjustment buckle assembly 200 that includes a first component 204, or main body, that may be coupled to a second component 208, or backplate. In the illustrated embodiment, the first component 204 includes a shaft 212 that is configured to be partially inserted into a receptacle 216 of the second component 208 when the first and second components 204, 208 are assembled. For example, assembling the adjustment buckle assembly 200 may involve the first and second components 204, 208 being axially aligned, i.e., coaxial, along a central axis C and brought toward each other. In this way, the first component 204 and the second component 208 may be mounted on opposing sides of a backpack strap, or the like, without the use of a webbing strip 104 or stitching 106. Differently said, the first and second components 204, 208 may be assembled together to clamp portions of a backpack strap therebetween. In some embodiments, the first component 204 or the second component 208, or both, may be made of stiff plastic, e.g., polyoxymethylene (POM), acrylonitrile butadiene styrene (ABS), nylon, polyethylene, etc.

Figure 3:
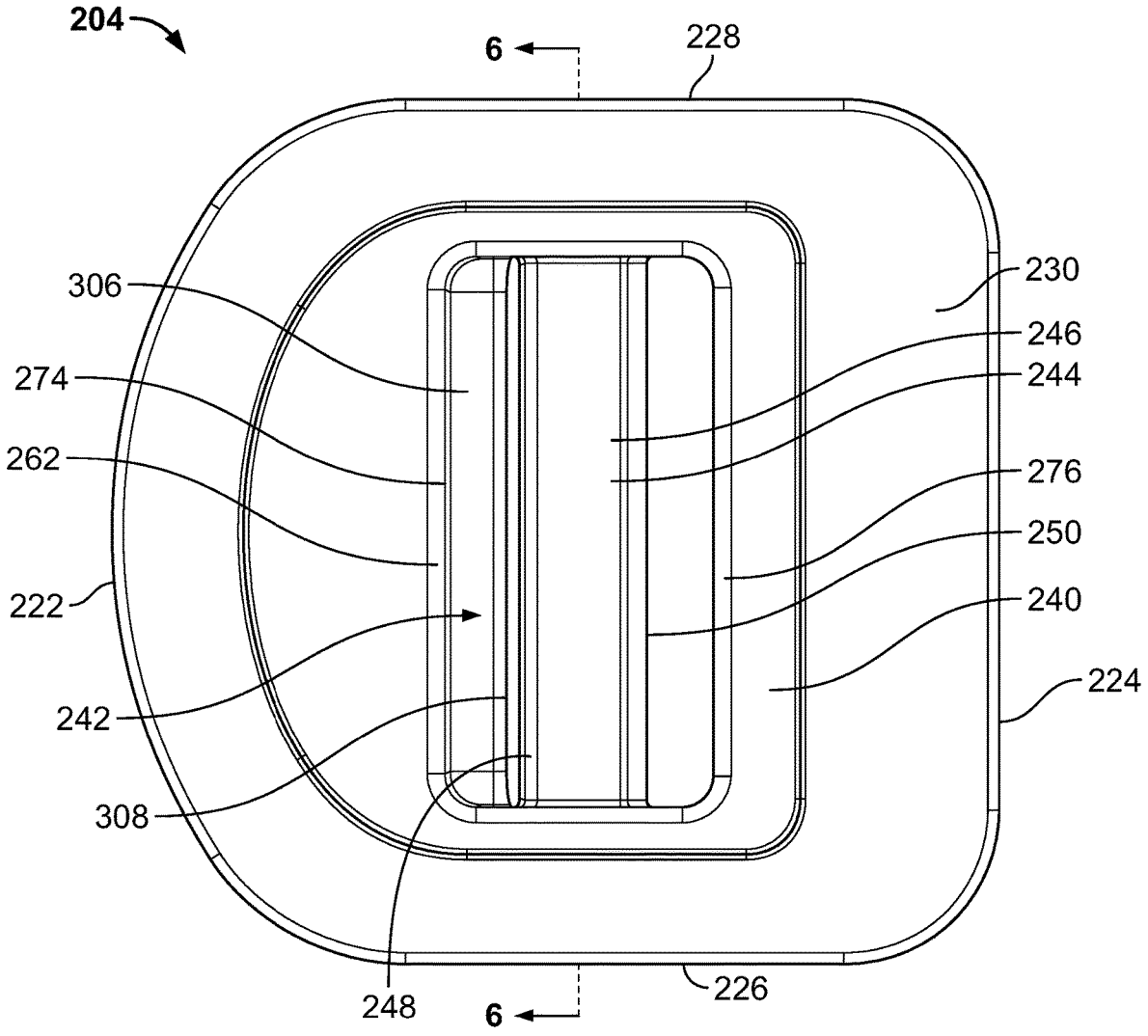
FIG. 3 is a top plan view of a first component of the adjustment buckle assembly of FIG. 2.

Referring to FIGS. 2 and 3, the first component 204 includes a flange 220 extending outwardly from the shaft 212, relative to the central axis C, to a front end 222, a rear end 224, and sides 226, 228 extending therebetween. The flange 220 includes a top surface 230 that is opposite a bottom surface 232 (see FIG. 4) from which the shaft 212 extends. In the illustrated embodiment, the front end 222 of the flange 220 curves about the central axis C between the sides 226, 228, while the rear end 224 of the flange 220 extends substantially linearly between the sides 226, 228. However, it is contemplated that the front end 222 and the rear end 224 may be differently shaped. It will be appreciated that the front end 222, the rear end 224, and the sides 226, 228 can comprise regions of the adjustment buckle assembly 200 and, thus, should not be limited to any particular surface(s).

With continued reference to FIGS. 2 and 3, a platform 240 extends from the top surface 230 of the flange 220 and a passage 242 extends through the platform 242 and the shaft 212 in a direction that is parallel with the central axis C. In the illustrated embodiment, the passage 242 is approximately centrally located between the sides 226, 228 and the front and rear ends 222, 224. Further, a bar 244 extends within the passage 242 between the sides 226, 228, the bar 244 defining an upper side 246 that extends between a forward side 248 and a rearward side 250. The bar 244 is stepped downardly from the platform 242 in a direction parallel with the central axis C. In the illustrated embodiment, the upper side 246 is generally planar and free of interruptions or indicia. However, in other embodiments, the upper side 246 of the bar 244 may comprise a plurality of interruptions, such as, e.g., ridges, ribs, indentations, textures, nubs, etc.

Figure 4:
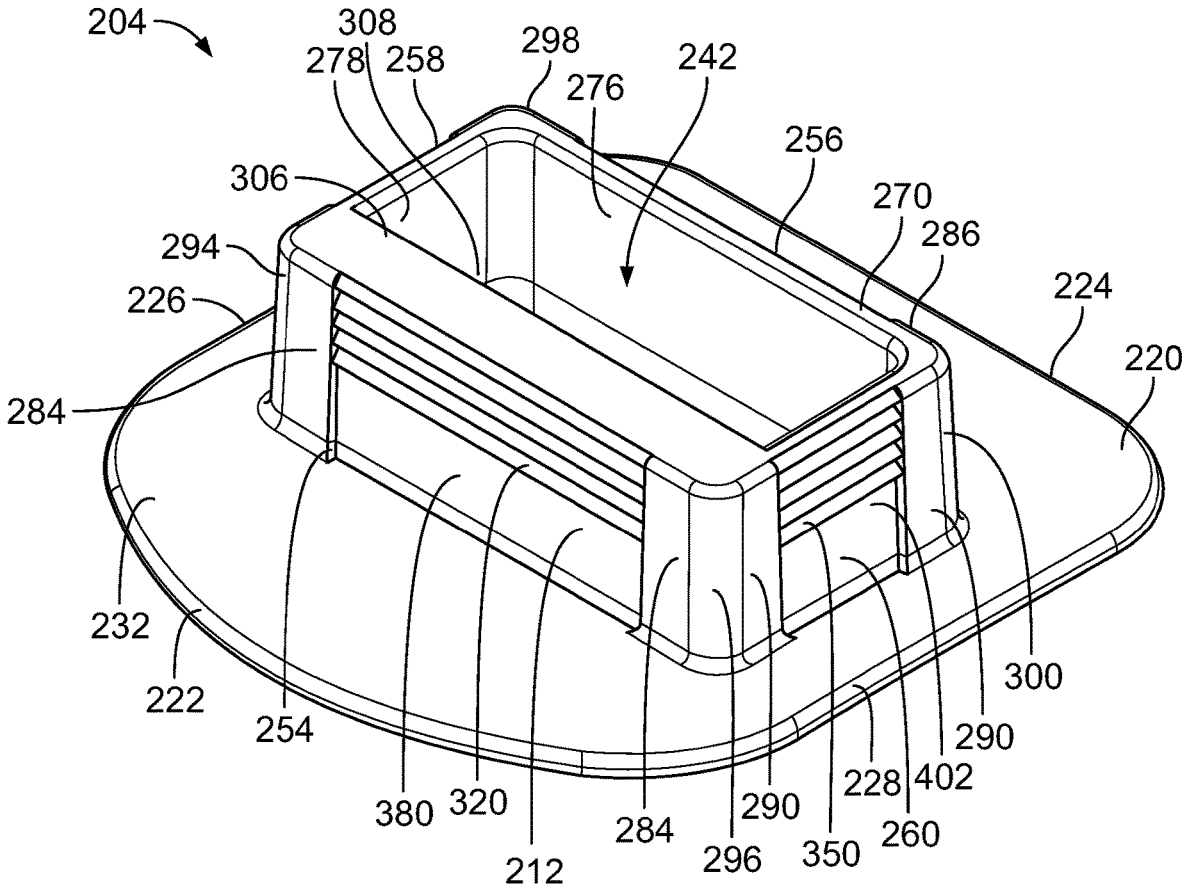
FIG. 4 is an isometric view of a bottom, front, and side of the first component of FIG. 3.
Figure 5:
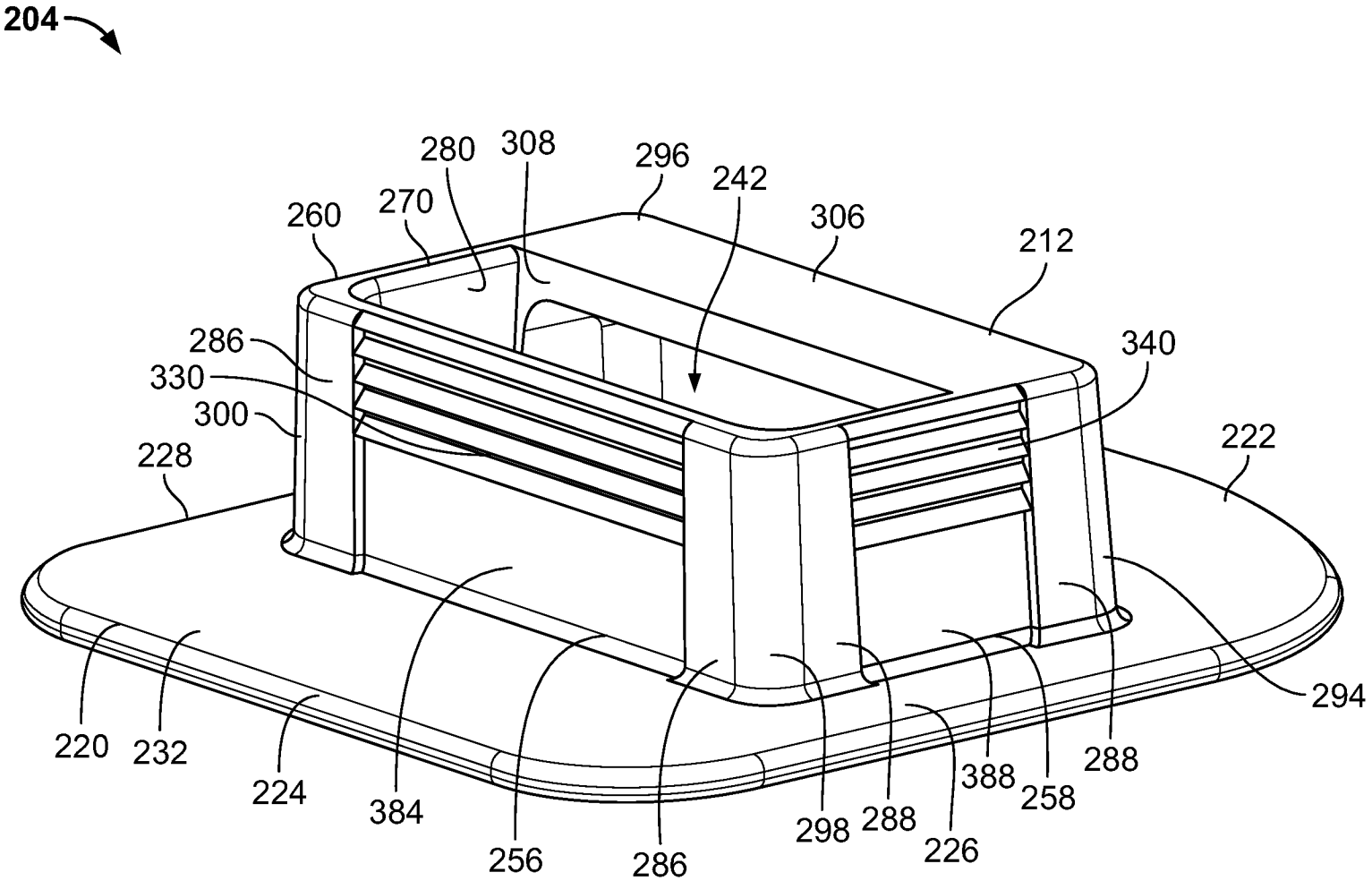
FIG. 5 is an isometric view of a bottom, rear, and side of the first component of FIG. 3.

Referring to FIGS. 4 and 5, the shaft 212 of the first component 204 includes a front wall 254 opposite a rear wall 256 and a pair of opposing side walls 258, 260 extending therebetween. In the illustrated embodiment, the shaft 212 is generally rectangular so that the front wall 254 and the rear wall 256 each define substantially the same distance between the side walls 258, 260. Similarly, the side walls 258, 260 each define substantially the same distance between the front and rear walls 254, 256. Further, each of the front, rear, and side walls 254, 256, 258, 260 are disposed approximately at right angles relative to each adjacent wall. However, the shaft 212 may be differently shaped and sized in other embodiments. In the illustrated embodiment, the shaft 212 is substantially centrally disposed on the bottom surface 232 of the flange 220 between the front end 222 and the rear end 224, as well as being centrally disposed between the sides 226, 228. However, it is contemplated that the shaft 212, or portions thereof, may be located closer to one or more of the ends of the flange 220.

In the illustrated embodiment, the shaft 212 extends between an upper end 262 where the shaft 212 merges with the platform 240 (see FIGS. 2 and 3) and a lower end 270 (see FIGS. 4 and 5), such that each of the front, rear, and side walls 254, 256, 258, 260 include respective upper and lower ends. Accordingly, the upper end 262 and the lower end 270 of the shaft 212 are disposed on opposite sides of the flange 220. It will be appreciated that the upper end 262 and the lower end 270 can comprise regions of the shaft 212 and, thus, should not be limited to any particular surface(s).

As illustrated in FIGS. 2 and 3, the front wall 254 includes an interior surface 274 that is configured to face an interior surface 276 of the rear wall 256, both of which extend between the upper end 262 and the lower end 270. In a similar manner, the side wall 258 includes an interior surface 278 that is configured to face an interior surface 280 of the side wall 260, both of which are configured to extend between the upper end 262 and the lower end 270.

In addition, and now referring to FIGS. 4 and 5, the front wall 254 includes an exterior surface 284 opposite the interior surface 274 and that extends from the bottom surface 232 of the flange 220 to the lower end 270. The rear wall 256 includes an exterior surface 286 opposite the interior surface 276 and that extends from the bottom surface 232 of the flange 220 to the lower end 270. The side walls 258 and 260 each include respective exterior surfaces 288, 290 opposite respective interior surfaces 278, 280 and that extend from the bottom surface 232 of the flange 220 to the lower end 270.

The front wall 254 is connected to and extends between the side walls 258, 260 and, thus, forms a corner or post with each of the side walls 258, 260. Likewise, the rear wall 256 is connected to and extends between the sidewalls 258, 260 and, thus, forms a corner or post with each of the side walls 258, 260. In the illustrated embodiment, a first post or corner 294 is located between the front wall 254 and the side wall 258, a second post or corner 296 is located between the front wall 254 and the side wall 260, a third post or corner 298 is located between the rear wall 256 and the side wall 258, and a fourth post or corner 300 is located between the rear wall 256 and the side wall 260. Each post comprises an exterior surface and an interior surface that curves between the respective adjacent walls. In some embodiments, the curvature of the interior surface of each post may be different than the curvature of the exterior surface. In other embodiments, there may not be any curvature on the interior or exterior surfaces of each post.

Figure 18:
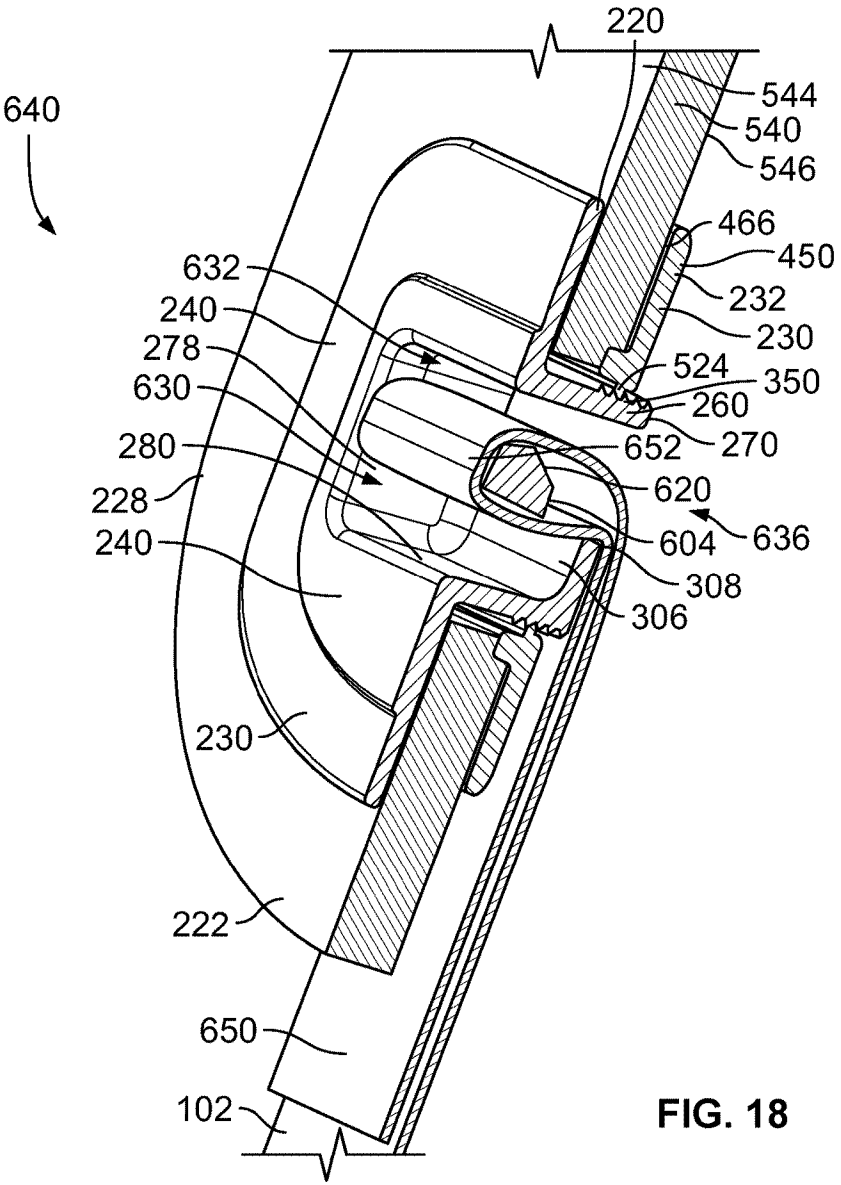
FIG. 18 is a section perspective view of a portion of a backpack strap showing an adjustment buckle assembly being assembled and mounted, the adjustment buckle assembly receiving webbing therethrough.

Staying with FIGS. 4 and 5, the lower end 270 of the shaft 212 includes a ledge 306 extending from the front wall 254 toward the rear wall 256 to a cut 308. In the illustrated embodiment, the cut 308 is located approximately centrally between the front wall 254 and the rear wall 256, but may be closer to the front wall 254 than to the rear wall 256. It is contemplated that the location of the cut 308 may be related to the location of the bar 244 to provide sufficient retention force against webbing 102 that is received in the passage 242 and looped over the bar 244, as illustrated in FIG. 18 and described in more detail below.

With continued reference to FIGS. 4 and 5, a plurality of teeth may be provided on two or more sides of the shaft 212 for engagement with the second component 208. In one example, the shaft 212 includes a front set of teeth 320, a rear set of teeth 330, and two side sets of teeth 340, 350, all of which are spaced apart from and coplanar with each other relative to a horizontal plane that intersects the shaft 212 in a direction orthogonal to the central axis C. In the illustrated embodiment, the front wall 254 carries the front set of teeth 320 on a recessed surface 380 of the exterior surface 284, the rear wall 256 carries the rear set of teeth 330 on a recessed surface 384 of the exterior surface 286, the side wall 258 carries the side set of teeth 340 on a recessed surface 388 of the exterior surface 288, and the side wall 260 carries the side set of teeth 350 on a recessed surface 402 of the exterior surface 290. In this way, the first component 204 includes sets of teeth 320, 330, 340, 250 that are carried by opposing walls 254, 256, 258, 260, respectively, of the shaft 212. Each of the front, rear, and side sets of teeth 320, 330, 340, 350 are disposed between the upper end 262 and the lower end 270 of the shaft 212. More specifically, each of the front, rear, and side sets of teeth 320, 330, 340, 350 are disposed closer to the lower end 270 of the shaft 212 than the upper end 262 and extend between respective first, second, third, and fourth posts 294, 296, 290, 300.

Figure 6:
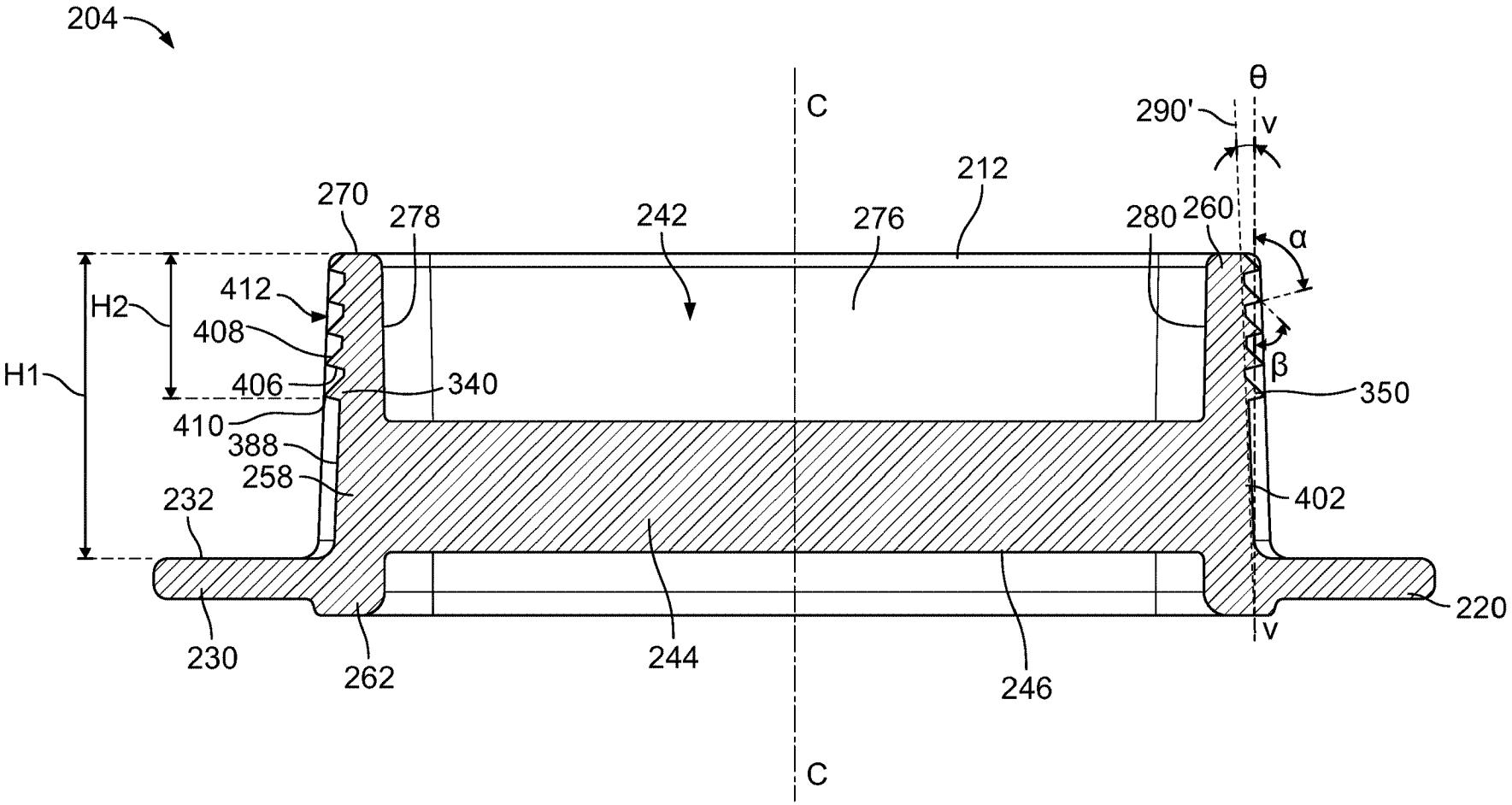
FIG. 6 is a section elevational view of the first component of FIG. 3 taken along the line 6-6.

FIG. 6 is a sectional view of the first component 204 being inverted and facing the interior surface 276 of the rear wall 256. As illustrated in FIG. 6, both of the side sets of teeth 340, 350 extend along respective recessed surfaces 388, 402 of respective side walls 258, 260. In the illustrated embodiment, the side sets of teeth 340, 350 are identical to each other and mirrored about the central axis C and, thus, may be referred to as opposing sets of teeth. It is contemplated that the front set of teeth 320 and the rear set of teeth 330 are also identical to each other and mirrored about the central axis C, such that the front set of teeth 320 and the rear set of teeth 330 may also be referred to as opposing sets of teeth. However, in some embodiments, the opposing sets of teeth may be different from each other and/or different from every other set of teeth carried by the shaft 212. It will be appreciated that aspects of the following description of the side set of teeth 340 may be applicable to the side set of teeth 350, as well as the front and rear sets of teeth 320, 330, as supported by the embodiment depicted in FIGS. 2-6.

As illustrated in FIG. 6, the lower end 270 of the shaft 212 extends from the bottom surface 232 a distance H1 and the side set of teeth 340 as extending along the recessed surface 388 from the lower end 270 a distance H2, which is approximately half of the distance H1. It is contemplated that the distance H2 may be greater than half of the distance H1 or less than half of the distance H1. In some embodiments, the distance H2 may be equal to the distance H1. Accordingly, the side set of teeth 340 may extend along part of the recessed surface 388, such as, e.g., a lower part or a part in the lower region. Further, the side set of teeth 340 includes a number of teeth arranged in an array along the recessed surface 388, the array having a distance equal to the distance H2.

In this particular embodiment, the side set of teeth 340 includes an array having five teeth, which for reference purposes may include a leading tooth and a trailing tooth located at opposite ends of the array. In this embodiment, the leading tooth is located nearest to the lower edge 270 and the trailing tooth is located at a point that is the distance H2 from the lower edge 270. Each tooth within the side set of teeth 340 includes an upper ramp 406 and a lower ramp 408 that meet at an apex 410. The apex 410 is the point of the tooth located farthest from the recessed surface 388. The upper ramp 406 extends at an upper angle $\alpha$ between the recessed surface 388 and the apex 410, and the lower ramp extends at a lower angle $\beta$ between the recessed surface 388 and the apex 410.

For illustrative purposes, a tooth among the side set of teeth 350, which is the opposing set of teeth to the side set of teeth 340, is provided with vectors that correspond with the upper angle $\alpha$ and the lower angle $\beta$ relative to the vertical axis V that is provided in FIG. 6 tangential to the exterior surface 290 of the side wall 260. In some examples, the upper angle $\alpha$ may be within a range of about 40 degrees to about 90 degrees, and the lower angle $\beta$ may be within a range of about 30 degrees to about 60 degrees. In the illustrated embodiment, the upper angle $\alpha$ is greater in magnitude than the lower angle $\beta$ It is contemplated that a ratio between the upper angle $\alpha$ and the lower angle $\beta$ may be in a range of about 1.01:1 to about 3:1. It is further contemplated that the upper angle $\alpha$ and the lower angle $\beta$ may be equal, i.e., a ratio of 1:1. As indicated by the foregoing description, the upper ramp 406 and the lower ramp 408 may extend at different angles relative to vertical, so as to define a mathematical relationship with each other, or at identical angles relative to vertical. It will be appreciated that the vector that represents the approximate position of the upper angle α extends in an opposite direction to the vector representing the approximate position of the lower angle β.

Further, a gap 412 is provided between two adjacent teeth, such that the gap 412 is substantially triangular-shaped and extends between the recessed surface 388 and the apex 410 of each adjacent tooth, as well as between the lower ramp 408 of one tooth and the upper ramp 406 of the adjacent tooth. For purposes of clarity, the following discussion relates to adjacent teeth T1 and T2 within any one of the set of teeth 320, 330, 340, 350. A distance between each tooth T1 and T2 may be measured from apex $\mathbf{410}_{T1}$ to apex $\mathbf{410}_{T2}$. In some embodiments, the teeth T1 and T2, or even all of the teeth in the array, may be equally spaced apart from each other, or the teeth may be spaced an incrementally increasing or decreasing distance from each other, or the teeth may be spaced unequal distances from each other. In some embodiments, the distance from apex $\mathbf{410}_{T1}$ to apex $\mathbf{410}_{T2}$, or from tooth T1 and tooth T2, can be represented by a mathematical relationship to the distance H2. For example, the distance from apex $\mathbf{410}_{T1}$ to apex $\mathbf{410}_{T2}$ relative to the distance H2 may be represented by a simple ratio of about 1:5. Alternatively, the distance from $\mathbf{410}_{T1}$ to apex $\mathbf{410}_{T2}$ may be represented by represented by a linear equation or, alternatively, a non-linear equation.

In addition, the shaft 212 of the first component 206 may taper as it extends from the flange 220. In the illustrated embodiment, the shaft 212 tapers in a vertical direction parallel with the central axis C so that side walls 258, 260 each extend from the bottom surface 232 toward the lower end 270 and inwardly toward the central axis C. In particular, the recessed surface 402 of the exterior surface 390 of the wall 260 may extend at a draft angle θ relative to the vertical axis V. The draft angle θ may be in a range from about 0.01 degrees to about 5 degrees, or from about 0.5 degrees to about 3.5 degrees, or from about 1.5 degrees to about 2.5 degrees. In the illustrated embodiment, the draft angle θ may be 2 degrees. The draft angle θ may be constant along the side wall 260 as it extends the distance H1 to the lower end 270, or the draft angle θ may vary as a function of the distance H1. Further, the draft angle θ may be the same as the angle at which the exterior surface 290 and/or the interior surface 280 is disposed, or each angle may be different from one another. In the illustrated embodiment, the side set of teeth 350 are disposed along the recessed surface 402 of the exterior surface 290 and, thus, the side set of teeth 350 are also disposed at an angle relative to the vertical axis V. In particular, the apex 410 of each tooth may extend an identical distance from the recessed surface 402 as each adjacent tooth, such that the apex 410 of the leading tooth nearest to the lower end 270 is disposed closer to the central axis C than the apex 410 of the trailing tooth. Accordingly, the draft angle θ may also correspond to the angle of a vector extending tangentially across the apex 410 of each tooth of the side set of teeth 350. However, it is contemplated that the side set of teeth 350 may include some teeth extending farther from the recessed wall 402 than others, which would result in such a tangential vector being disposed at an angle relative to the vertical axis V that is different from the draft angle θ.

With continued reference to FIG. 6, the bar 244 is illustrated extending from side wall 258 to side wall 260, and more specifically, from the interior surface 278 to the interior surface 280. The upper side 246 is spaced vertically from the platform 240 toward the lower end 270 and the bar 244 extends farther toward the lower end 270 to approximately half of the distance H1. However, it is contemplated that the bar 244 may be disposed farther toward the upper end 262 or farther toward the lower end 270 than shown in FIG. 6. Alternatively, the bar 244 may extend farther toward the lower end 270 or farther toward the upper end 262 than shown in FIG. 6.

Figure 8:
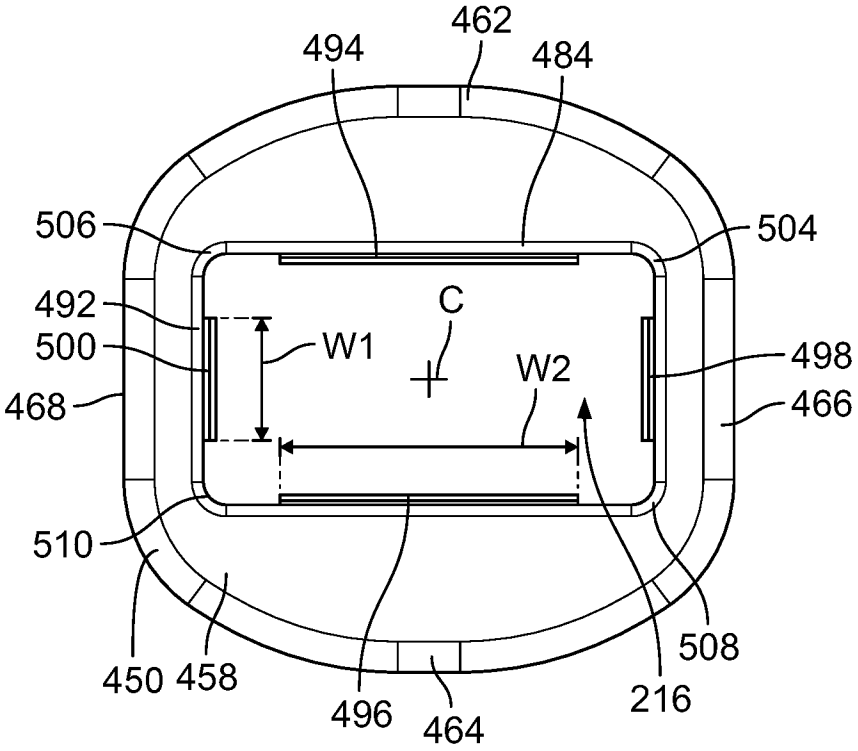
FIG. 8 is a bottom view of the second component of FIG. 7.
Figure 7:
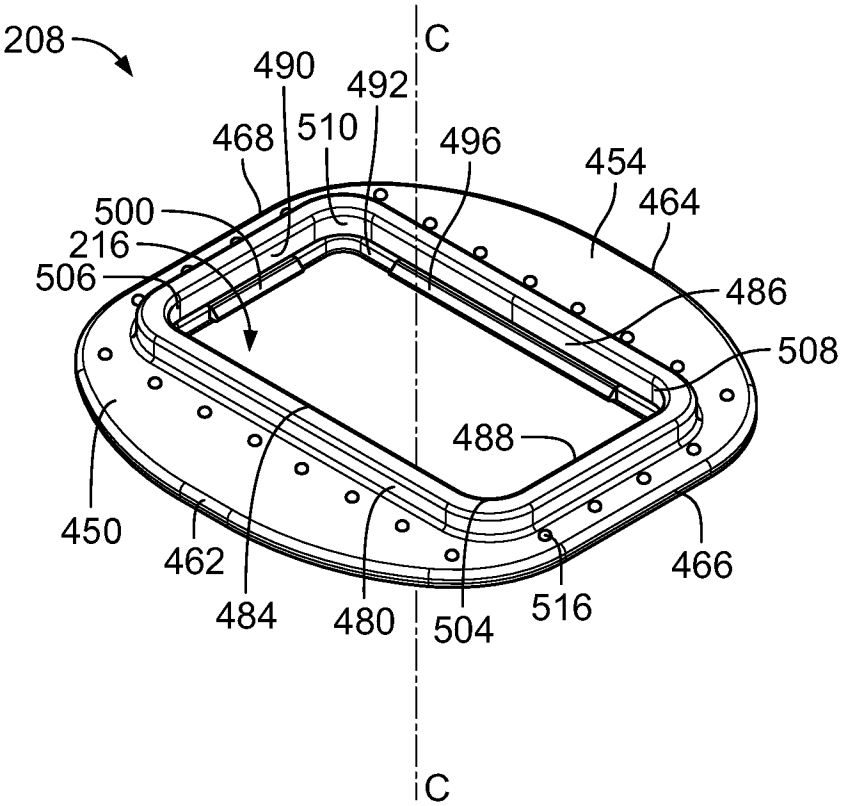
FIG. 7 is an isometric view of a top, front, and side of a second component of the adjustment buckle assembly of FIG. 2.

Turning now to FIGS. 7 and 8, the second component 208 includes a base 450 and the receptacle 216 extends through a top surface 454 and a bottom surface 458 opposite the top surface 454. The base 450 includes a front end 462, a rear end 464 opposite the front end 462, and a pair of sides 466, 468 extending therebetween. In the illustrated embodiment, the front end 362 and the rear end 464 of the base 450 may curve between the sides 466, 468, while the sides 466, 468 extend substantially linearly between the front end 462 and the rear end 464. However, the base 450 may be differently shaped than shown. Further, it will be appreciated that the front, rear, and side ends 462, 464, 466, 468 may comprise a region and, thus, should not be limited to any particular surface(s).

As best seen in FIG. 7, the second component 208 includes a rim 480 extending from the top surface 454 of the base 450 and surrounding the receptacle 216. In the illustrated embodiment, the rim 480 extends vertically from top surface 454 to an upper surface 482. In some embodiments, the rim 480 may extend at an angle from the top surface 454. The rim 480 at least partially defines the receptacle 216, with particular reference to inner surfaces formed between the upper surface 482 and the bottom surface 458 of the base 450. For example, the rim 480 may include a plurality of interior surfaces that includes front surface 484, a rear surface 486, and side surfaces 488, 490 that extend between the front and rear surfaces 484, 486. In the illustrated embodiment, the rim 480 is generally rectangular-shaped, but may be shaped differently in other embodiments. A brace 492 extends into and about the receptacle 216 near the bottom surface 458 and adjacent to the front, rear, and side surface 484, 486, 488, 490.

With reference to FIGS. 2, 7, and 8, the second component 208 may include a plurality of ribs extending within the receptacle 216. For example, the plurality of ribs may be disposed along portions of the brace 492 and the rim 480 or along multiple portions thereof, or elsewhere on the second component 208 suitable for engagement with the first component 204. In the illustrated embodiment, the plurality of ribs may include a front rib 494, a rear rib 496 opposite the front rib 494, and side ribs 498, 500 that are located at least partially between and at an angle relative to the front rib 494 and the rear rib 496. In one particular embodiment, the front rib 494 extends along the brace 492 adjacent to the front surface 484 of the rim 480 within the receptacle 216, the rear rib extends along the brace 492 adjacent to the rear surface 486 of the rim 480 within the receptacle 216, and the side ribs 490, 500 extend along the rime 492 adjacent to respective side surfaces 488, 490 of the rim 480 within the receptacle 216. Each of the front, rear, and side ribs 494, 496, 498, 500 project inwardly into the receptacle 216, so that the front rib 494 and the rear rib 496 extend toward each other and the side ribs 498, 500 extend toward each other.

Further, a first channel or corner 504 is formed by the brace 492 and the rim 480 between the front surface 484 and the side surface 488, a second channel or corner 506 is located between the front surface 484 and the side surface 490, a third channel or corner 508 is located between the rear surface 486 and the side surface 488, and a fourth channel or corner 510 is located between the rear surface 486 and the side surface 490. When the adjustment buckle assembly 100 is assembled, the first post 294 of the first component 204 is configured to be aligned with and received by the first channel 504 of the second component 208, such that the first post 294 corresponds to the first channel 504. Similarly, the second post 296 of the first component 204 is configured to be aligned with and received by the second channel 506 of the second component 208, such that the second post 296 corresponds to the second channel 506. The third post 298 of the first component 204 is configured to be aligned with and received by the third channel 508 of the second component 208, such that the third post 298 corresponds to the third channel 508. The fourth post 300 of the first component 204 is configured to be aligned with and received by the fourth channel 510 of the second component 208, such that the fourth post 300 corresponds to the fourth channel 510. In this way, the shaft 212 of the first component 204 may be aligned with and received by the rim 480 of the second component 208. It is contemplated that the shaft 212 may be sized and shaped to align with and be received by the rim 480 even when the first component 204 is rotated approximately 180 degrees about the central axis C, such that the first, second, third, and fourth posts 294, 296, 298, 300 may be configured to correspond with the fourth, third, second, and first channels 510, 508, 506, 504, respectively. It is further contemplated that each of the posts may be sized and shaped differently from each other to facilitate alignment of the first component 204 and the second component 208 for assembly.

With reference to the bottom view of FIG. 8, the side rib 500 is shown disposed substantially centrally on the side surface 490 between the second corner 506 and the fourth corner 510. Further, the side rib 500 extends along the side surface 490 a distance W1, which is less than a distance between the front surface 484 and the rear surface 486. It will be appreciated that the side rib 498 spans between the first channel 504 and the third channel 508, less than the distance between the front surface 484 to the rear surface 486, and substantially equivalent to the distance W1. However, it is contemplated that the side ribs 498, 500 may span different distances or be sized and shaped differently from each other. In addition, the front rib 494 is shown disposed substantially centrally on the front surface 484 between the first channel 504 and the second channel 506 and, also, extending along the front surface 484 a distance W2.

As illustrated in FIG. 7, the second component 208 includes a plurality of nubs 516 that are configured to grip a material of a backpack strap, or the like. For example, a rear surface of the backpack strap may be formed with a mesh fabric material having a pattern of holes included therealong into which some or all of the plurality of nubs 516 may be received. As a result, the plurality of nubs 516 provide increased friction between the rear surface of the backpack strap and the base 450. In the illustrated embodiment, each of the plurality of nubs 516 is spaced apart from each other and arranged along a rectilinear path that surrounds the rim 480. In this way, the plurality of nubs 516 are outwardly spaced from the rim 480, so that some of the plurality of nubs 516 are located near the front end 462, some of the plurality of nubs 516 are located near the rear end 464, and some of the plurality of nubs 516 are located near each of the sides 466, 468. It is contemplated that there may be greater or fewer nubs 516 than shown and the nubs 516 may be sized and shaped differently than shown. Further, it is contemplated that the nubs 516 may be arranged differently along the base 450 or provided on other surfaces of the second component 208 or on at least one surface of the first component 204.

Figure 9:
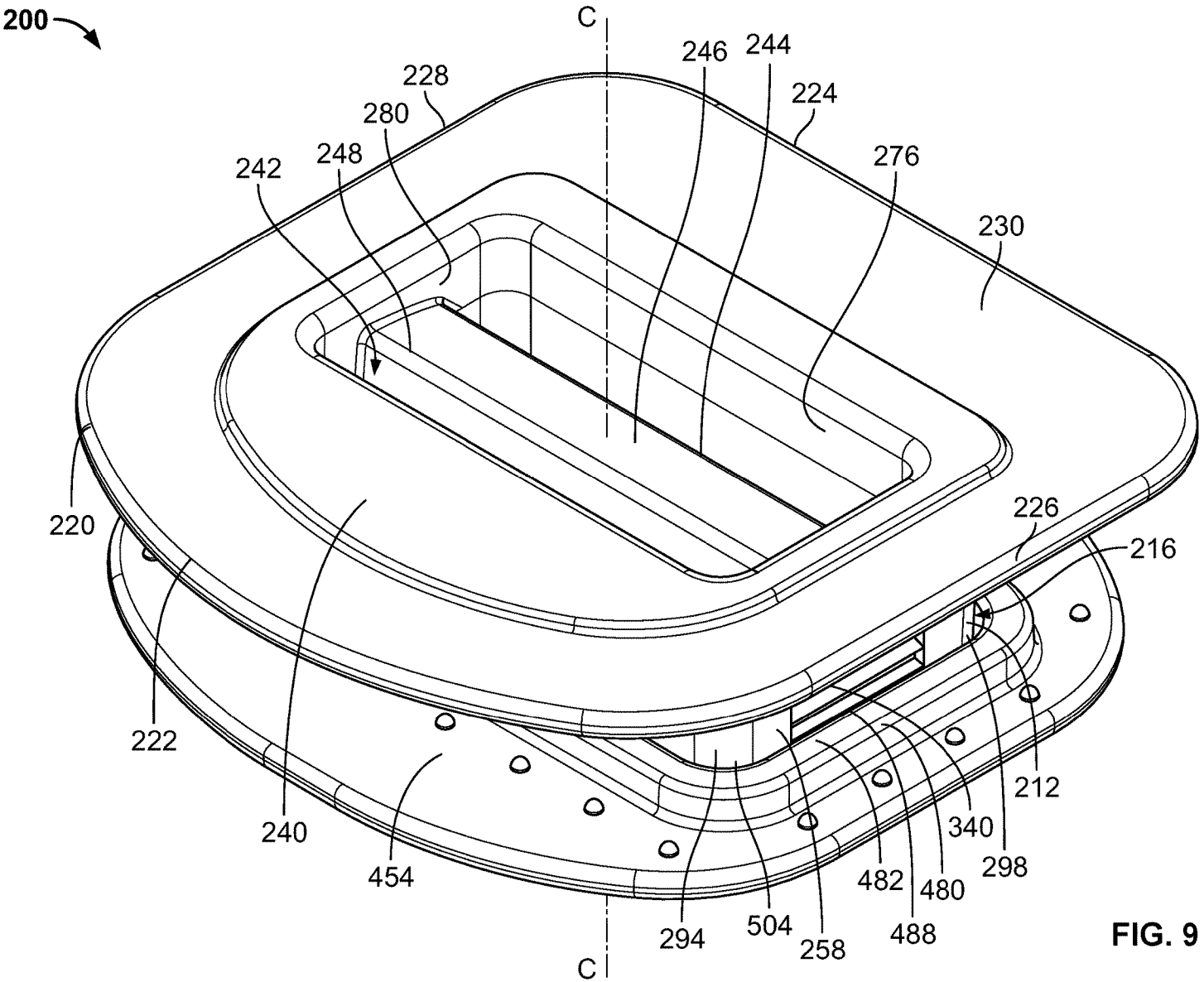
FIG. 9 is an isometric view of a top, front and side of the adjustment buckle assembly of FIG. 2, the adjustment buckle assembly being depicted in an assembled state.

Referring to FIG. 9, the adjustment buckle assembly 200 is depicted in an assembled state. Such an assembled state may be achieved by aligning first component 204 and the second component 208 coaxially along the central axis C and positioning the shaft 212 of the first component 204 toward the receptacle 216 of the second component 208 (as seen in FIG. 2). Then, as shown in FIG. 9, the lower end 270 of the shaft 212 is at least partially inserted within the receptacle 216 so that the first post 294 aligns with and is received by the first channel 504 of the rim 480. Accordingly, the remaining second, third, and fourth posts 296, 298, 300 are aligned with and received by the corresponding second, third, and fourth channels 506, 508, 510 of the rim 480. As a result, the side set of teeth 340 of the side wall 258 is positioned adjacent the side rib 498 of the side surface 488. Similarly, and simultaneously, the opposing side set of teeth 350 of the side wall 260 is positioned adjacent the side rib 500 of the side surface 490, while the front set of teeth 320 of the front wall 254 is positioned adjacent the front rib 494 of the front surface 484 and the rear set of teeth 330 of the rear wall 256 is positioned adjacent the rear rib 496 of the rear surface 486. Accordingly, the front, rear, and side sets of teeth 320, 330, 340, 350 are configured to be aligned with and received by corresponding front, rear, and side ribs 494, 496, 498, 500, respectively. In addition, the passage 242 of the shaft 212 is brought into communication with the receptacle 216 during assembly of the adjustment buckle assembly 200 and the upper side 246 of the bar 244 is configured to face away from the second component 208. In the illustrated embodiment, the bar 244 is positioned substantially centrally within the passage 242 such that the central axis C intersects the bar 244. It is contemplated that the bar 244 may be positioned farther toward the front end 222 or the rear end 224 than shown so as to be offset from the central axis C.

Figure 10:
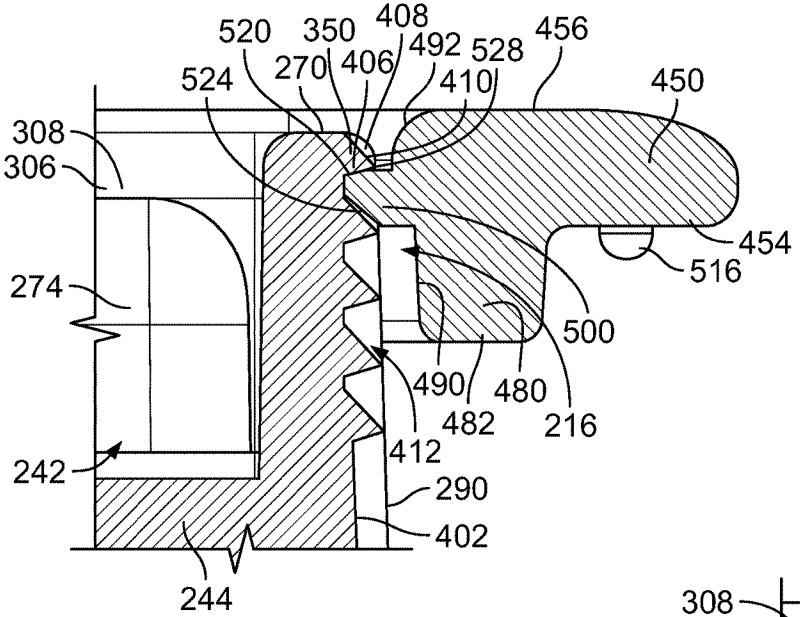
FIG. 10 is a partial sectional view of a portion of the adjustment buckle assembly of FIG. 2 being depicted in one example of an assembled state.

Referring to FIG. 10, a partial, sectional view of the adjustment buckle assembly 100 is depicted inverted and in an initial capture stage, where the side rib 500 is disposed near the lower end 270 of the shaft 212 and captured between adjacent teeth of the set of teeth 350. In particular, the side rib 500 is shown in contact with the leading tooth near the lower end 270 of the shaft 212, such that the side rib 500 is engaged with the leading tooth and an adjacent tooth of the set of teeth 350. The side rib 500 includes a tip 520 disposed between a slope 524 and an underside 528, with the underside 528 extending between the brace 492 and the tip 520. The tip 520 is disposed at a distal end of the side rib 500 and, as such, the tip 520 is spaced closer to the central axis C than the side surface 490.

In the initial capture stage shown in FIG. 10, the tip 520 of the side rib 500 is positioned adjacent to and in contact with the upper ramp 406 of the leading tooth in the set of teeth 350, while the apex 410 of the leading tooth of the set of teeth 350 is positioned adjacent to and in contact with the underside 528 of the side rib 500 and the slope 524 of the side rib 500 is positioned adjacent to the lower ramp 408 of the adjacent tooth. Further, the apex 410 of the leading tooth is aligned with and spaced a first distance from the brace 492 while the apex 410 of the adjacent tooth is aligned with and spaced a second distance from the side surface 490, where the first distance is greater than the second distance. In the illustrated embodiment, the apex 410 of each tooth of the side set of teeth 350 is coplanar with the exterior surface 290 of the side wall 260, but the apex 410 of each tooth of the side set of teeth 250 may be spaced differently relative to the side wall 260 than shown. Accordingly, the side set of teeth 350 are arranged proximate to but spaced apart from the side surface 490 of the rim 480. In addition, the cut 308 of the ledge 306 within the passage 242, as well as the lower end 270 of the shaft 212, is located within the receptacle 216 in the initial capture stage, such that the lower end 270 of the shaft is located between the bottom surface 458 and the top surface 454 of the base 450. In addition, a first compressive force exists between the tip 520 of the side rib 500 and the recessed wall 402 of the side wall 260 during the initial capture stage, while a gap exists between the slope 524 of the side rib 500 and the lower ramp 408 of the adjacent tooth. Accordingly, the initial capture stage occurs during assembly of the first component 204 and the second component 208 after the shaft 212 is aligned within and inserted into the receptacle 216.

Figure 11:
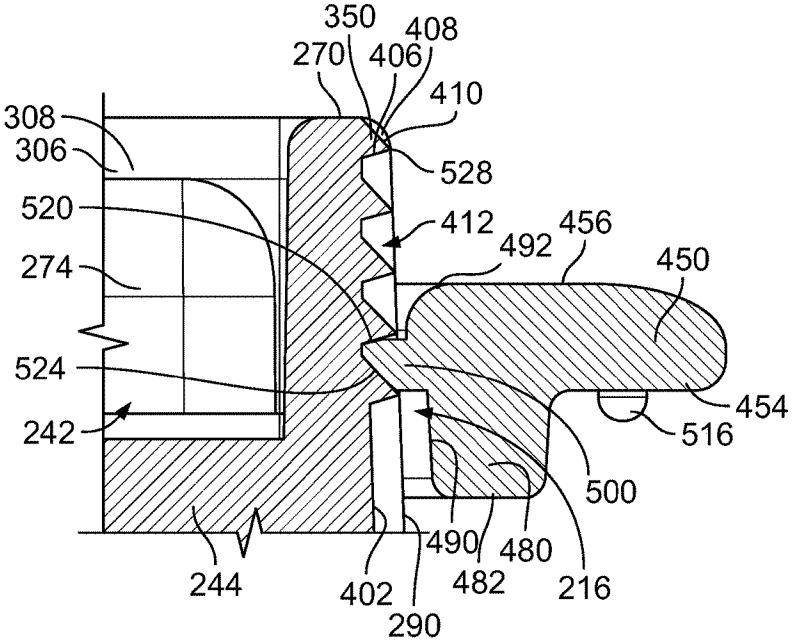
FIG. 11 is a partial sectional view of a portion of the adjustment buckle assembly of FIG. 2 being depicted in another example of an assembled state.

Referring to FIG. 11, the adjustment buckle assembly 100 is depicted in a maximum capture stage, e.g., a fourth capture stage, where the lower end 270 of the shaft 212 is inserted entirely through and beyond the receptacle 216 and the side rib 500 is captured between the trailing tooth and an adjacent tooth of the side set of teeth 350. As such, the apex 410 of the adjacent tooth is disposed along and in contact with the underside of the side rib 500, being spaced a third distance from the brace 492 that is smaller than the first distance of the initial capture stage. That is, due to the side wall 260 and the recessed wall 402 being disposed at the draft angle θ, the leading tooth of the side set of teeth 350 is positioned farther inwardly from the brace 492 and the side surface 490 of the second component 208 than the trailing tooth. Accordingly, a fourth or maximum compressive force exists between the tip 520 of the side rib 500 and the recessed wall 402 during the maximum capture stage. Further, as illustrated in FIG. 11, there is no gap between the slope 524 of the side rib 500 and the lower ramp of the trailing tooth of the set of teeth 350, in contrast to the gap existing in the initial capture stage in FIG. 10.

Accordingly, moving from the initial capture stage to the maximum capture stage involves inserting the shaft 212 of the first component 204 through the receptacle 216 of the second component 208. As a result, the tip 520 of the side rib 500 engages with and becomes captured, at least momentarily, between adjacent teeth of the side set of teeth 350 incrementally from the leading tooth to the trailing tooth, with each successive capture stage including a greater compressive force between the first and second components 204, 208 than the previous capture stage, until the maximum compressive force is reached at a final capture stage. Thus, the tip 520 of the side rib 500 can be said to ratchet from successive capture stages, and a fit between the shaft 212 of the first component 204 and the second component 208 increasingly tightens as a result of the increased compressive force. In part due to the material selection of the first component 204 and the second component 208, as well as the dimensional tolerances and the rigidity provided by the rim 480 of the second component and the walls 254, 256, 258, 260 of the shaft 212, there is some flexure that occurs in various elements of the first component 204 and the second component 208 during movement from the initial capture stage to the maximum capture stage. Thus, the fit between the first component 204 and the second component 208 intensifies from a loose fit, e.g., a clearance fit, in the initial capture stage to an interference fit in the fourth or final capture stage. Further, it will be understood that at the maximum capture stage shown in FIG. 11 the tip 520 of the side rib 500 is prevented from sliding over the lower ramp 408 of the trailing tooth because of the trailing tooth's outward position relative to the central axis C as a result of the draft angle θ of the side wall 260.

As can be appreciated from FIGS. 1-9, the foregoing description of the initial capture stage (FIG. 10) and the maximum capture stage (FIG. 11) is also applicable to the front, rear, and side set of teeth 320, 340, 350 and the front, rear and side ribs 494, 496, 498, respectively. In addition, persons skilled in the art will understand that some alignment aids may be included or built into the adjustment buckle assembly 100. For example, the initial capture stage may be intended for the purpose of alignment rather than for mounting to a luggage. In some embodiments, the first and second capture stages may be provided for alignment, while subsequent capture stages are provided for mounting to the luggage. In other embodiments, only a final capture stage is provided for mounting to a luggage while the preceding capture stages are provided for alignment. In these embodiments, some of the capture stages are provided for alignment while a remainder of the capture stages are provided for mounting to a luggage. Further, in the initial capture stage (FIG. 10), the first component 204 is loosely coupled to the second component 208 such that a user may easily separate them. However, in the maximum capture stage (FIG. 11), the first component is securely held to the second component 208 such that a semi-permanent attachment occurs. As a result, the first component 204 is securely held to the second component 208 at the maximum capture stage.

As previously mentioned, this semi-permanent attachment is due in part to the rigidity imparted by the material selection of the first component 204 and the second component 208. Further, unintended disassembly is prevented in part by the rigidity imparted by the placement and thickness of the rim 480 along the base 450 and provides for some flexibility during movement among consecutive capture stages. Still further, the rigidity imparted by the placement and thickness of the walls 254, 256, 258, 260 of the shaft 212, particularly near the first, second, third, and fourth posts 294, 296, 298, 300, cooperates with their respective draft angles θ and the plurality of teeth to prevent unintended disassembly and provides for incrementally increasing attachment between the initial capture stage and the maximum capture stage. It is contemplated that greater or fewer capture stages may be provided than shown, in part by increasing or decreasing the number of teeth in the plurality of teeth provided by each wall of the shaft 212. Further, the attachment or hold between the first and second components 204, 208 may be manipulated by providing sets of teeth provided on less than all of the walls of the shaft 212, or by placing the sets of teeth at varying locations along the shaft 212, such as, e.g., at staggered distances from the upper end 262 or bottom surface 232 of the flange 220.

Figure 13:
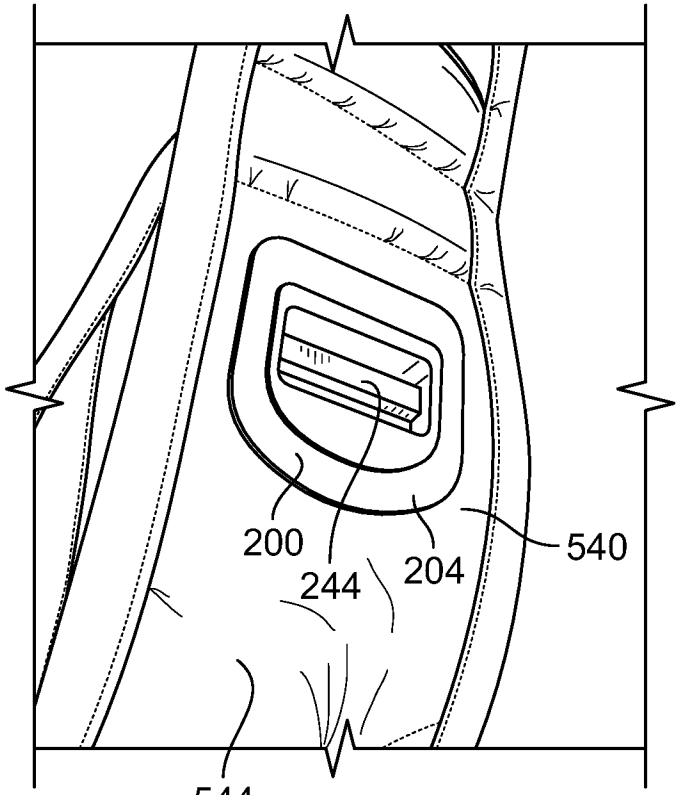
FIG. 13 is a partial top view of the backpack strap of FIG. 12, depicting the adjustment buckle assembly of FIG. 2 being assembled and mounted.
Figure 12:
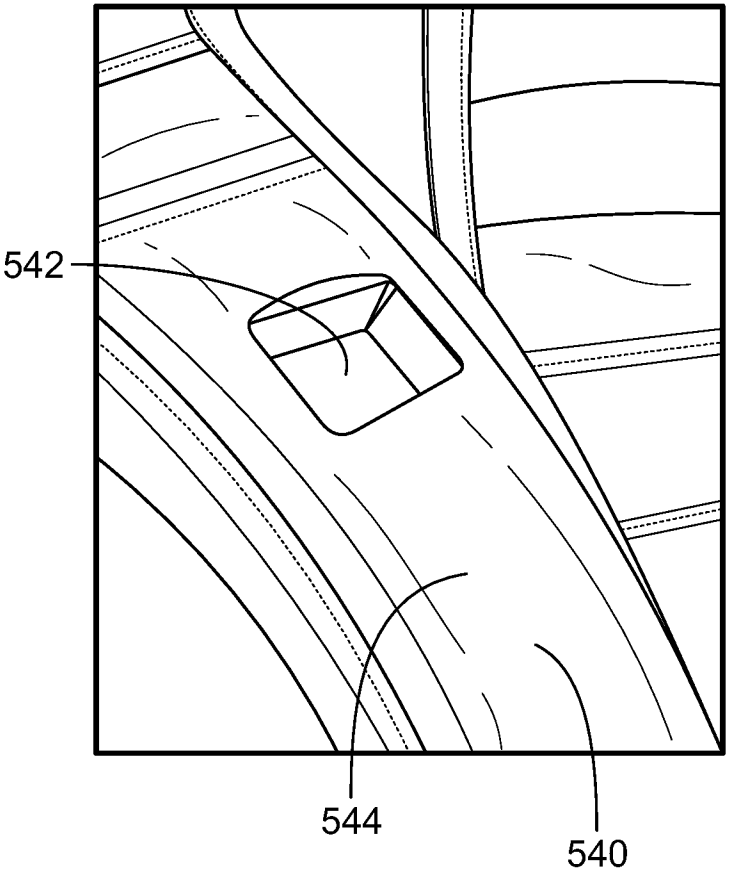
FIG. 12 is a partial top view of a backpack strap to which an adjustment buckle assembly of the present disclosure may be attached.
Figure 14:
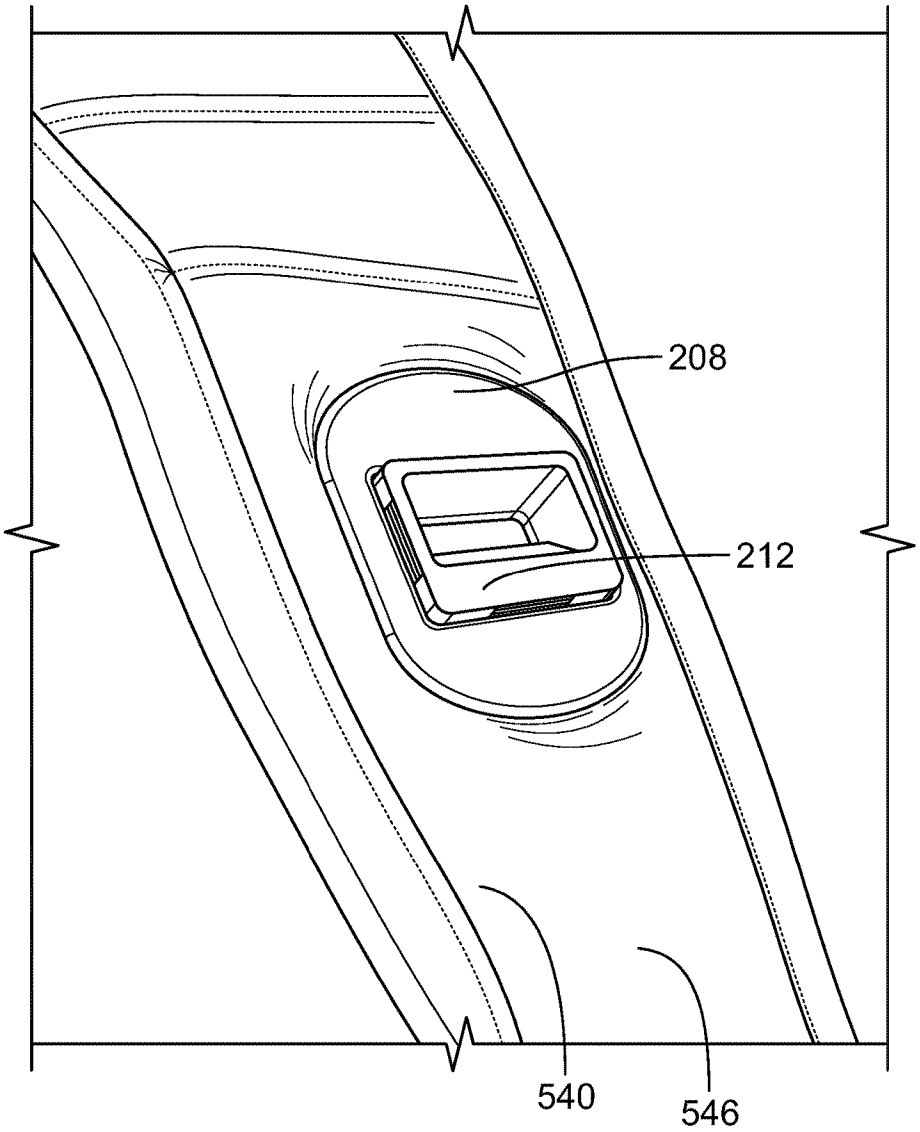
FIG. 14 is a partial rear view of the backpack strap of FIG. 12, depicting the adjustment buckle assembly of FIG. 2 being assembled and mounted.

FIGS. 12-14 illustrate an example of a backpack strap 540 in which an opening 542 is formed, preferably by a die cut or similar method, through an outer side 544 and an inner side 546. When the adjustment buckle assembly 200 is mounted to the backpack strap 540, the first component 204 is positioned adjacent to the outer side 544 and the second component 208 is positioned adjacent to the inner side 546. Further, the bar 244 is positioned at least partially within the opening 542 and between the outer side 544 and the inner side 546 of the backpack strap 540.

Figure 15:
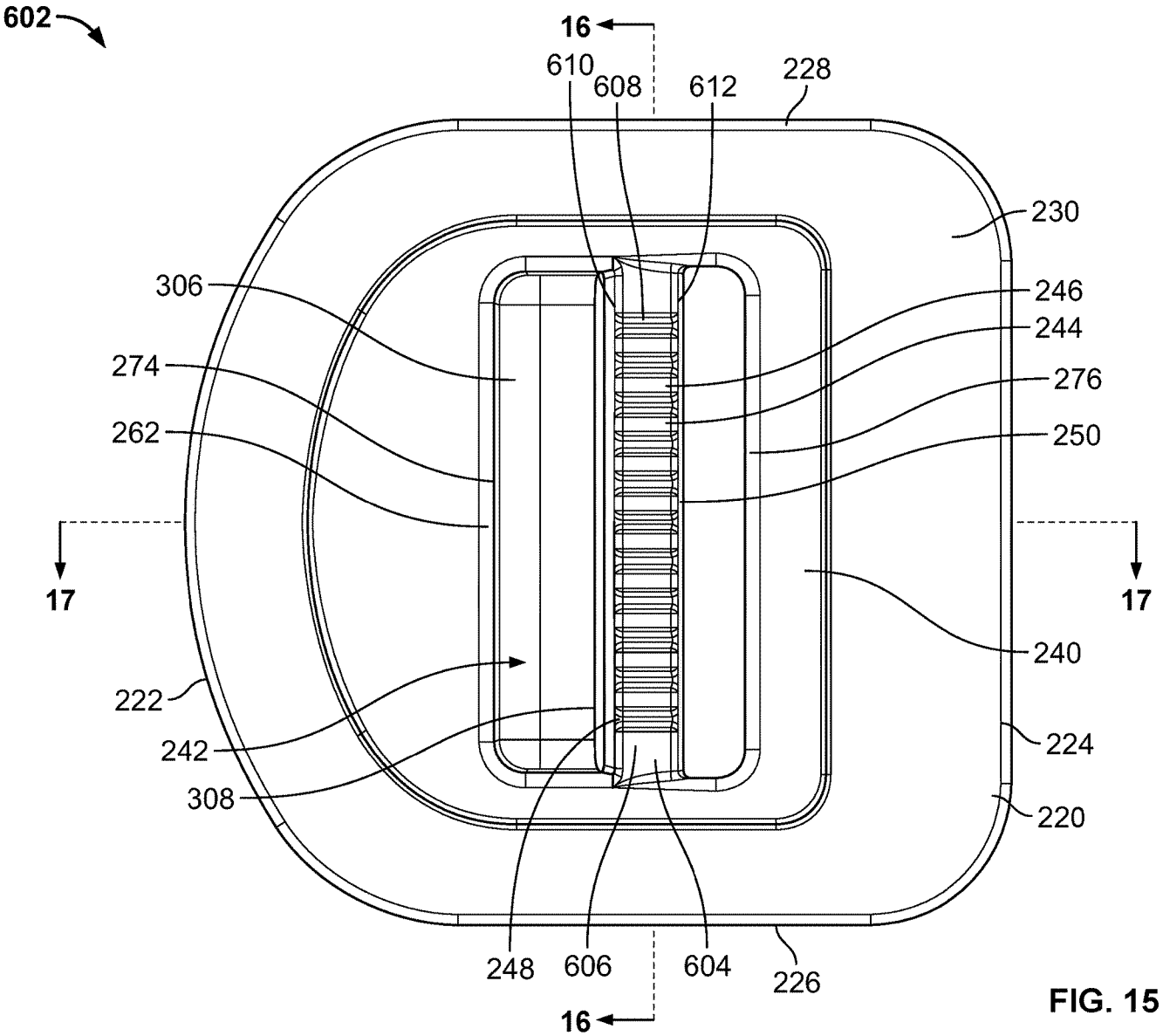
FIG. 15 is a top plan view of a first component of another embodiment of an adjustment buckle assembly.

Referring now to FIG. 15, a top plan view of another embodiment of a first component 602 is illustrated with a modified bar 604 as compared to the bar 244 of the first component 204. It will be appreciated that the first component 602 and the first component 204 include similar elements and, as such, like elements will be labeled using like reference numerals. In the illustrated embodiment of FIG. 15, the bar 604 includes an upper side 606 having an engagement feature 608 arranged between side 226 and side 228. Further, the bar 604 includes a forward side 610 and a rearward side 612 opposite the forward side 610, where the engagement feature 608 extends between the forward side 610 and the rearward side 612.

Figure 16:
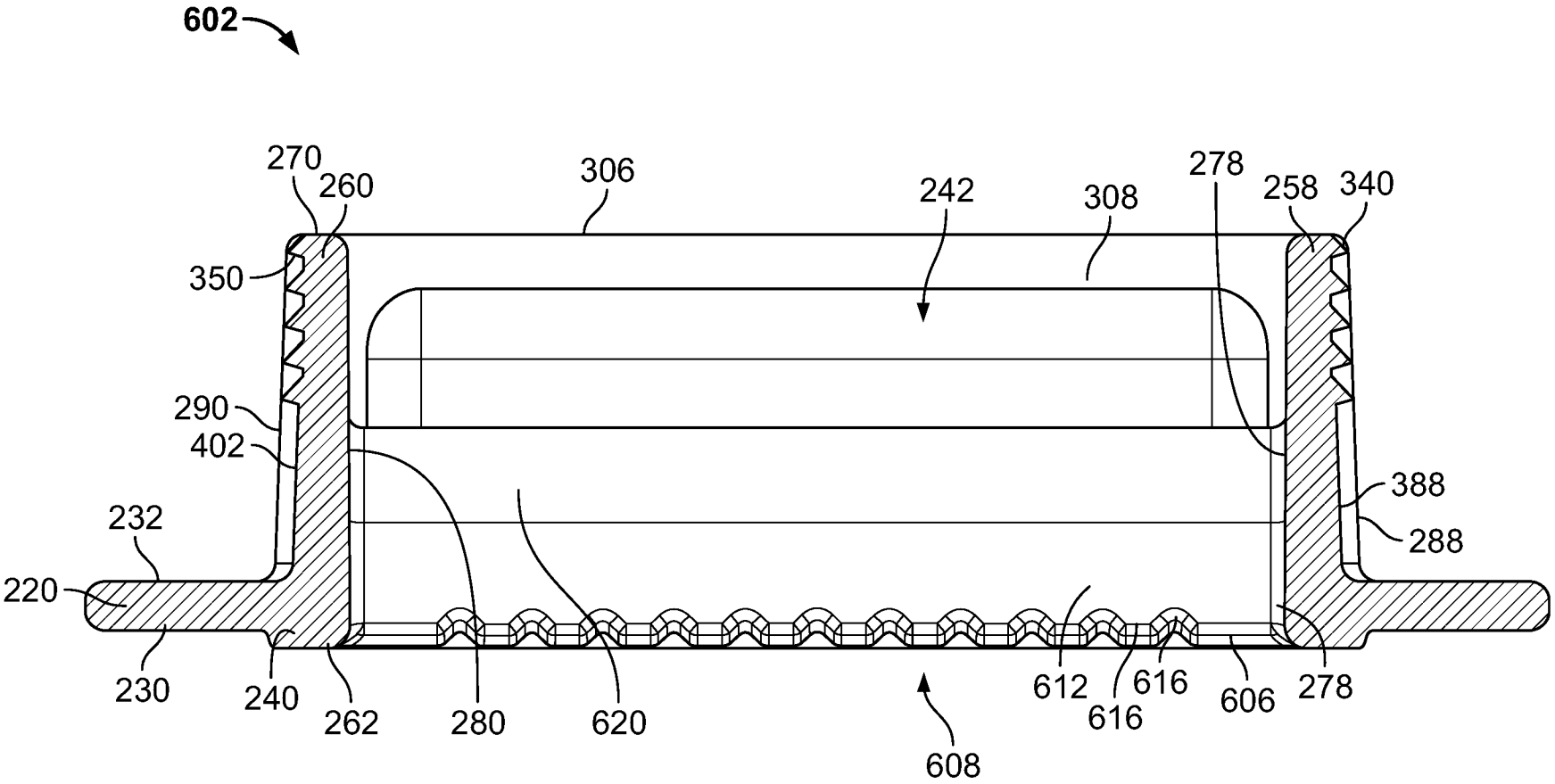
FIG. 16 is a section elevational view of the first component of FIG. 15 taken along the lines 16-16.
Figure 17:
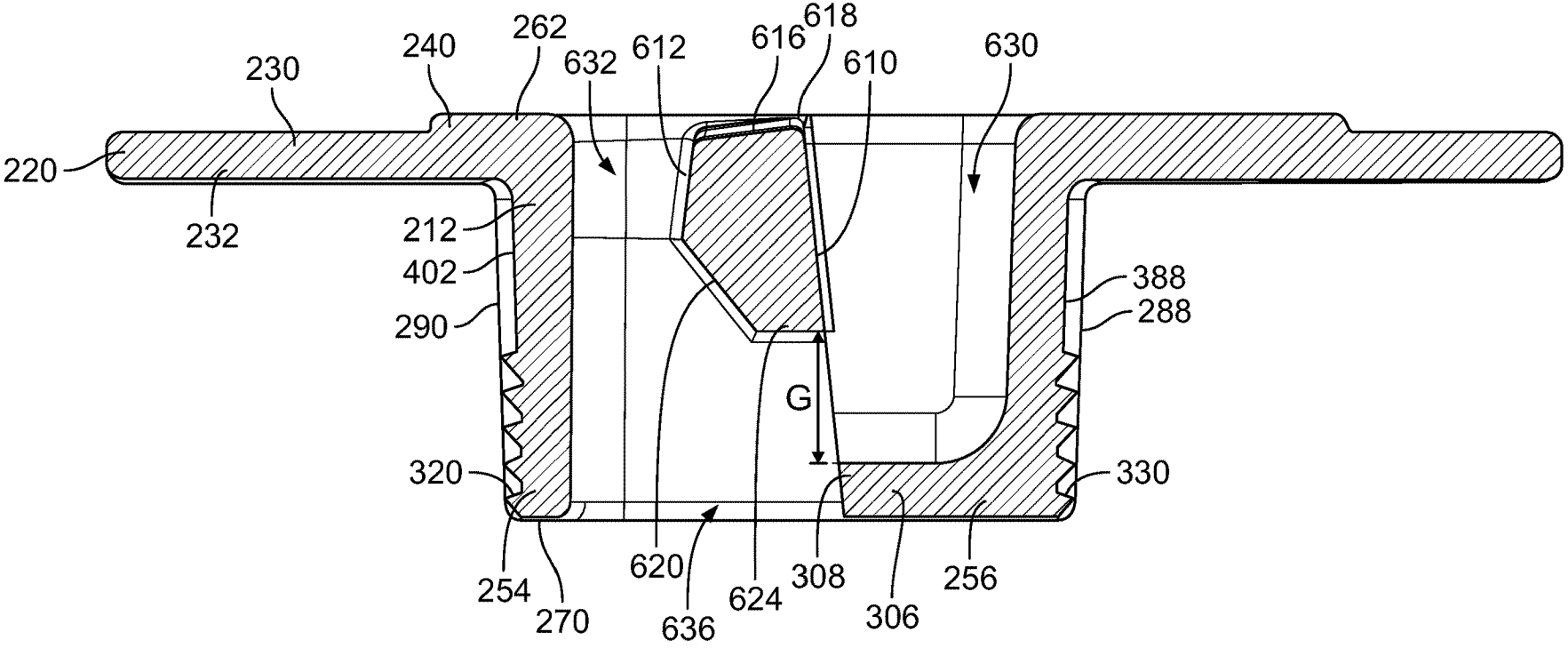
FIG. 17 is a section elevational view of the first component of FIG. 15 taken along the lines 17-17.

As illustrated in the sectional views of FIGS. 16 and 17, the engagement feature 608 includes a plurality of valleys 616 and a plurality of ridges 618 arranged consecutively to define a substantially sinusoidal profile. The engagement feature 608 is provided on the upper side 606 of the bar 604 to increase frictional resistance and grip with webbing 102, allowing portions of the webbing 102 to bend into the valleys 616 between the ridges 618, thereby causing the webbing 102 to fold and form anticline and syncline portions that stiffen a portion of the webbing 102 to prevent unintended loosening during use. Further, an angled panel 620 extends between the rearward side 612 and a bottom edge 624 of the bar 604, thereby extending in a forward and downward direction toward the cut 308 of the ledge 306.

As best seen in FIG. 17, the first component 602 includes a forward opening 630 along the forward side 610 of the bar 604 and a rearward opening 632 defined along the rearward side 612 of the bar 604. The upper side 606 and the engagement feature 608 located thereon extends at an angle between the forward side 610 and the rearward side 612, and the upper side 606 is positioned substantially coplanar with the platform 240 at the upper end 262 of the shaft 212. The forward opening 630 extends from the upper end 262 toward the ledge 306 to form a gap G between the cut 308 and the bottom edge 624 of the bar 604. The rearward opening 632 extends downward from the upper end 262 to a bottom opening 636 that spans between the cut 308 and the front wall 260. As such, the forward opening 630, the rearward opening 632, and the bottom opening 636 are in communication with each other.

As illustrated in FIG. 18, the first component 602 may be coupled to the second component 208 to form an adjustment buckle assembly 640 that is mounted to the backpack strap 540. In the illustrated embodiment, the first component 602 and the second component 208 are attached to each other by engagement between the plurality of teeth 350 on the shaft 212 and the plurality of ribs of the second component 208. In particular, the first and second component 602, 208 are shown in an intermediate capture stage that results in a semi-permanent attachment to each other and to the backpack strap 540. A portion of the backpack strap 540 is positioned between the flange 220 of the first component 602 and the base 450 of the second component 208, such that the backpack strap 540 is clamped between the adjustment buckle assembly 640. It will be appreciated that because movement from the initial capture stage to the maximum capture stage involves movement of the flange 220 of the first component 602 toward the base 450 of the second component 208 that reduces a distance between the flange 220 and the base 450, material disposed between the flange 220 and the base 450 experiences a lighter clamping force at the initial capture stage than in subsequent capture stages until the fourth or maximum capture stage. In this way, the amount of clamping force exerted between the first and second components 602, 208 is proportional to the capture stage, where the clamping is lightest at the initial capture stage and greatest at the maximum capture stage.

Also, it is contemplated that an audible clicking or snapping sound is generated during movement between capture stages. For example, a user or manufacturer may listen for the number of clicks to identify when the adjustment buckle assembly 200, 640 has ratcheted to the desired capture stage. Accordingly, the plurality of teeth and/or the plurality of ribs, which together comprise the ratchet of the adjustment buckle assembly 200, 640, may be formed of or coated with a material that improves or amplifies such a clicking sound. Alternatively or additionally, the ratchet may be configured with teeth and/or ribs that protrude varying distances or are spaced apart from each other varying distances that are pre-determined to impart particular clicking characteristics, such that a user can listen for a unique click that is associated with the maximum capture stage after identifying a unique click associated with the alignment or initial capture stage.

Referring to FIG. 18, an end 650 of the webbing 102 has been looped up through the bottom opening 636 to the rearward opening 632, over the bar 604 and down again through the bottom opening 636 of the adjustment buckle assembly 640 to form a loop 644 therein around the bar 604, such that the webbing 102 becomes crimped against itself by the cut 308 of the ledge 306 within the bottom opening 636. As a result, a user may pull on the end 650 to draw more webbing 102 through the adjustment buckle assembly 640 so as to tighten the backpack strap 540. When a user stops pulling on the end 650 of the webbing 102, the cut 308 presses the webbing 102 against itself to prevent the end 650 from moving back toward the adjustment buckle assembly 640. The placement of the bottom edge 624 in relation to the cut 308, as well as the engagement feature 608 on the bar 604, the angled upper side 606 of the bar 604, and the offset location of the bar 604 relative to the bottom opening all cooperate to prevent the webbing 102 from becoming loosened or slackened during use. In addition, the adjustment buckle assembly 640 is mounted to the backpack strap 540 without use of stitching or additional webbing strips 104.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the present disclosure and claims. The entire disclosure of each patent and publication cited herein is incorporated by reference, as if each such patent or publication were individually incorporated by reference herein.

The invention claimed is:

1. An adjustment buckle assembly, comprising:

a first component having a shaft, a bar extending between opposing sides of the shaft, and a flange extending outwardly from the shaft;

a second component having a base that defines a receptacle, wherein the shaft is configured to be at least partially inserted into the receptacle, wherein the shaft tapers inwardly relative to a central axis extending centrally through the first component, wherein the shaft includes a recessed wall extending between opposing thickened corners, wherein the recessed wall includes a set of teeth of a plurality of teeth that are configured to engage with a plurality of ribs carried on the second component, and wherein the set of teeth are disposed at an angle relative to the central axis.

2. The adjustment buckle assembly of claim 1, wherein the bar is positioned approximately centrally between a front end and a rear end.

3. The adjustment buckle assembly of claim 2, wherein the bar includes an engagement feature disposed along an upper side.

4. The adjustment buckle assembly of claim 3, wherein the engagement feature includes a plurality of ridges and a plurality of valleys.

5. The adjustment buckle assembly of claim 1, wherein the second component includes a rim disposed along a periphery of the receptacle and extending outwardly from a top surface of the base.

6. The adjustment buckle assembly of claim 5, wherein the plurality of ribs are disposed along a brace that extends about the receptacle, the brace protruding uniformly inwardly relative to the central axis and positioned between the rim and a bottom surface of the base.

7. The adjustment buckle assembly of claim 6, wherein the plurality of ribs each include a sloped surface and a tip.

8. The adjustment buckle assembly of claim 7, wherein a tooth of the plurality of teeth includes an upper ramp and a lower ramp each extending from a recessed wall to an apex.

9. The adjustment buckle assembly of claim 8, wherein the tip of the rib is configured to abut the recessed wall and the sloped surface is configured to contact the upper ramp.

10. An adjustment buckle assembly, comprising:

a main body including a hollow shaft extending from a flange, the hollow shaft including opposing walls each carrying two or more teeth thereon; and a backplate including opposing surfaces each carrying a rib that faces a receptacle, wherein the opposing walls of the shaft are configured to be aligned with the opposing surfaces of the backplate, wherein the opposing walls are disposed at an angle relative to a vertical axis, wherein the main body is configured to retain a strap within the hollow shaft, wherein the teeth are disposed at an angle relative to the vertical axis, the teeth include a leading tooth and a trailing tooth, wherein the rib of each of the opposing surfaces is configured to engage with the teeth of each of the opposing walls to hold the main body to the backplate, and wherein a first capture stage is defined when the rib is captured between the leading tooth and an adjacent tooth of the teeth.

11. The adjustment buckle assembly of claim 10, wherein a maximum capture stage is defined when the rib is captured between the trailing tooth and an adjacent tooth of the teeth.

12. The adjustment buckle assembly of claim 11, wherein at the maximum capture stage the main body is semi-permanently attached to the backplate.

13. A method of providing an adjustment buckle assembly, comprising:

providing a first component having a flange, a hollow shaft having a lower end, and a bar extending between opposing sides of the shaft; and providing a second component having a base with a bottom surface opposite a top surface and a rim extending outwardly from the top surface to an upper surface, wherein the shaft is configured to be received within the second component, and wherein the shaft includes a plurality of posts that are configured to be aligned with and received by a plurality of channels of the second component, and wherein the shaft is configured to be received within the second component such that the bottom surface is between the flange and the lower end.

14. The method of providing the adjustment buckle assembly of claim 13, wherein the rim is configured to flex when the shaft is received within the second component at various stages, a first stage including the lower end of the shaft being disposed between the top surface and the bottom surface and a second stage including the lower end of the shaft being disposed below the bottom surface that is below the top surface.

15. The method of providing the adjustment buckle assembly of claim 14, wherein the plurality of posts are each disposed at an angle relative to a vertical axis, the plurality of posts being disposed nearer to the rim at the second stage than at the first stage.

* * * * *